United States Patent [19]

Nash

[11] Patent Number: 4,606,323

[45] Date of Patent: Aug. 19, 1986

[54] MAGNETO FOR IGNITION SYSTEM

[75] Inventor: Donald R. Nash, Berkey, Ohio

[73] Assignee: Allied Corporation, Morris Township, N.J.

[21] Appl. No.: 728,991

[22] Filed: Apr. 30, 1985

[51] Int. Cl.[4] ..... F02P 1/00

[52] U.S. Cl. ..... 123/602; 123/149 D; 315/209 CD; 310/70 A

[58] Field of Search ..... 123/149 C, 149 D, 418, 123/599, 601, 602; 310/70 R, 70 A, 72, 74; 315/209 SC, 209 CD

[56] References Cited

U.S. PATENT DOCUMENTS

| | | | |
|---|---|---|---|
| 3,484,677 | 12/1969 | Piteo | 322/91 |
| 3,630,185 | 12/1971 | Struber | 123/602 |
| 3,853,107 | 12/1974 | Sieja | 123/598 |
| 3,948,239 | 4/1976 | Katsumata | 123/149 C |
| 4,036,201 | 7/1977 | Burson | 123/599 |
| 4,119,076 | 10/1978 | Sato | 123/602 |
| 4,150,652 | 4/1979 | Nagasawa | 123/602 |
| 4,157,702 | 6/1979 | Ogasawala et al. | 123/149 C |
| 4,163,437 | 8/1979 | Notaras et al. | 123/651 |
| 4,202,305 | 5/1980 | Wolf | 123/599 |
| 4,270,509 | 6/1981 | Tharman | 123/647 |
| 4,324,215 | 4/1982 | Sieja | 123/335 |
| 4,351,286 | 9/1982 | Aylott | 123/601 |
| 4,401,096 | 8/1983 | Podrapsky | 123/631 |
| 4,402,298 | 9/1983 | Morita | 123/599 |
| 4,404,940 | 9/1983 | Sieja | 123/335 |
| 4,404,952 | 9/1983 | Fujimoto et al. | 123/602 |
| 4,441,478 | 4/1984 | Fujimoto | 123/602 |

*Primary Examiner*—Willis R. Wolfe, Jr.

*Attorney, Agent, or Firm*—Markell Seitzman; Russel C. Wells

[57] ABSTRACT

A magneto (10) comprising an E-type stator (12) and a rotor (14) movable relative to the stator (12) to induce therein a varying flux field. The three legs or poles (18, 20, 22) of the stator (14) are asymmetrically placed and the center pole (20) supports a charge coil (40) and a trigger coil (42). A suppression coil (42), wound about an iron core (50), is remotely positioned and electrically isolated from the stator poles (18, 20, 22) and situated within a larger spacing (34) defined by the asymmetrically placed stator poles (18, 20, 24).

15 Claims, 7 Drawing Figures

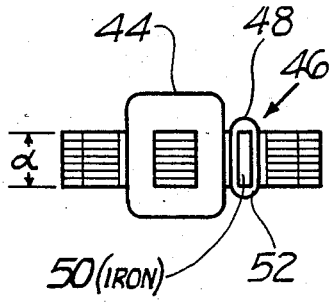
Fig-2
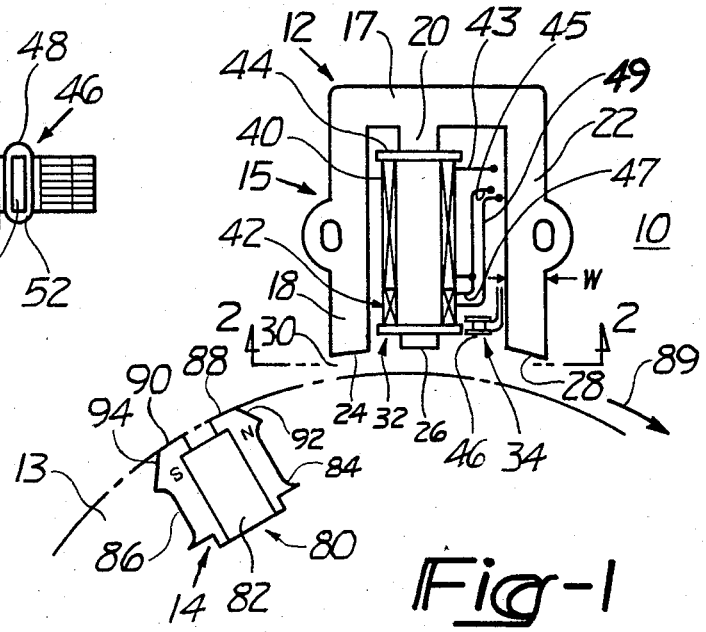
Fig-1
Fig-3
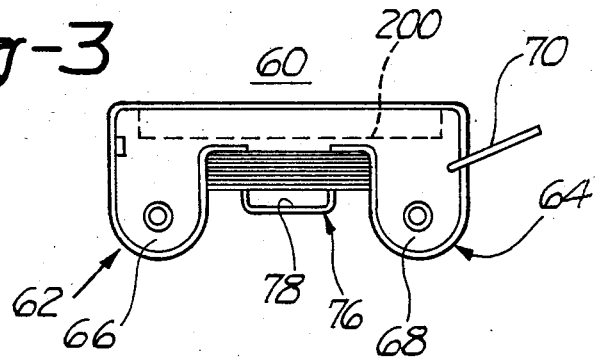
Fig-4
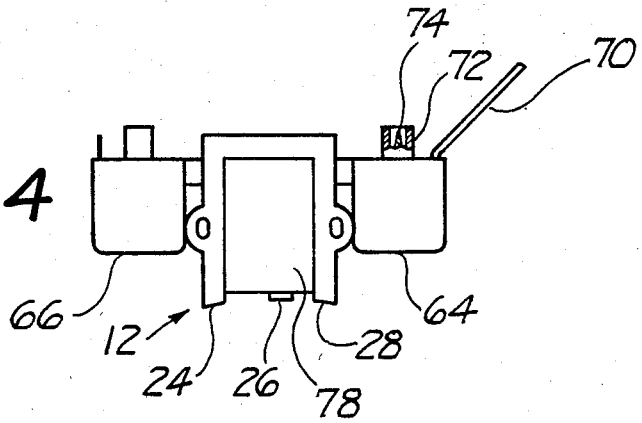

MAGNETO FOR IGNITION SYSTEM

BACKGROUND AND SUMMARY OF THE INVENTION

The present invention relates to an improved magneto for an engine ignition system. More particularly, the invention relates to a magneto which generates first and second induce voltage waveforms wherein the phase of the second induced voltage waveform varies relative to the first induced voltage waveform in proportion to the speed of the engine.

The magneto of this invention is particularly useful with small engines of the type commonly used in chain saws, snow blowers, portable power generators, lawn mowers and the like. While the preferred embodiment of the invention is described for use with a two cylinder engine, this is not a limitation of the invention in that the invention may be extended to multi-cylinder engines by incorporation of a distributor of a know type or use a plurality of magnetos with each of the cylinders.

Magnetos for use with ignition systems such as capacitive discharge or inductive systems have used various coil and core arrangements positioned adjacent a moving rotor which includes a magnet attached to and movable with the engine flywheel or fan. As the rotor passes the core or stator various voltages are induced in the coils. One such device incorporating an E-type stator supporting a plurality of coils is shown in my commonly assigned U.S. Pat. No. 4,509,493 which issued Apr. 8, 1985.

The magneto of the illustrated embodiment of my invention generates a plurality of AC voltage waveforms. More particularly, the magneto generates first and second voltage waveform which include first and a second trigger pulses. The uniqueness of the present invention is that the second trigger pulse of the second waveform automatically advances in time relative to the generation of the second trigger pulse of the first waveform as a function of engine speed. By properly spacing the coils embedded in the stator the second trigger pulse of the second waveform can be controlled such that at a predetermined nominal engine speed its phase will have advanced a sufficient amount such that this second trigger pulse occurs simultaneously with or slightly before the second trigger pulse of the first waveform. This variable phase or walking phenomena can be sensed by associated control circuitry to automatically change the ignition spark timing from retard to advance or used for other purposes. Once coil spacing has been established, based upon the charcteristics of the particular engine in use no further calibration is required.

It is an object to provide a simply constructed magneto capable of generating a walking or phase variable waveform. A further object of the invention is to provide a magneto which solves the deficiencies in the prior art. Most prior magneto control circuits make use of the change in amplitude of signals that occur as flywheel speed changes. The deficiency of these systems is in that the control circuitry responds to other conditions that affect signal amplitude. These circuits typically require calibration on the assembly line to accommodate the variations in electronic components, which results in high labor costs, and still vary in performance when installed on an engine because of changes in temperature, changes in module to magnet air gap, changes in electronic components as they age, etc. My invention is insensitive to signal amplitudes and responds only to the distance between two windings (which is fixed upon manufacture) and flywheel speed.

Accordingly the present inventions comprises:

A magneto for an engine ignition system comprising means for generating a first induced voltage; and means for generating a second induced voltage having a phase which varies relative to said first induced voltage in proportion to the speed of the engine. More particularly, the magneto comprises means for generating a first induced voltage characterized by a first portion or first trigger pulse of a first polarity, followed by a second portion of opposite polarity and a third portion or second trigger pulse of the first polarity; and means for generating a second induced voltage characterized by a first portion or first trigger pulse of the first polarity followed by a second portion of the opposite polarity, and a third portion or second trigger pulse having a phase which varies relative to the second trigger pulse of the first induced voltage in proportion to the speed of the engine. The magneto also includes means for generating a third induced voltage of polarity opposite to the polarity of the first induced voltage. More specifically the magneto comprises an E-type pickup or stator comprising a core including three parallel extending poles which can be asymmetrically spaced terminating at end faces; and a rotor comprising permanent magnet means for producing a varying flux field in the stator, adapted to be moved across the end faces to produce the varying flux field.

When using asymmetrically spaced poles the poles define a first spacing between a second or center pole and a first pole and a larger second spacing between the center pole and a third pole. The stator is positioned relative to the rotor such that the rotor moves across the stator from the first pole toward the third pole. The magneto further includes a first or charge coil and a second or trigger coil both wound about the center pole. A third or suppression coil is wound about a ferromagnetic core and positioned in the second spacing remote from the core preferably though not necessarily proximate the end face of the center pole and electrically isolated, from the trigger coil.

Many other objects, advantages and purposes of the invention will be clear from the detailed description of the drawings.

BRIEF DESCRIPTION OF THE DRAWINGS

In the drawings:

FIG. 1 illustrates a schematic representation of the stator and rotor of the present invention.

FIG. 2 illustrates a plan end view of the stator of FIG. 1.

FIG. 3 illustrates a top view of a housing.

FIG. 4 illustrates a side plan view of the housing.

DETAILED DESCRIPTION OF THE DRAWING

Figure 5:
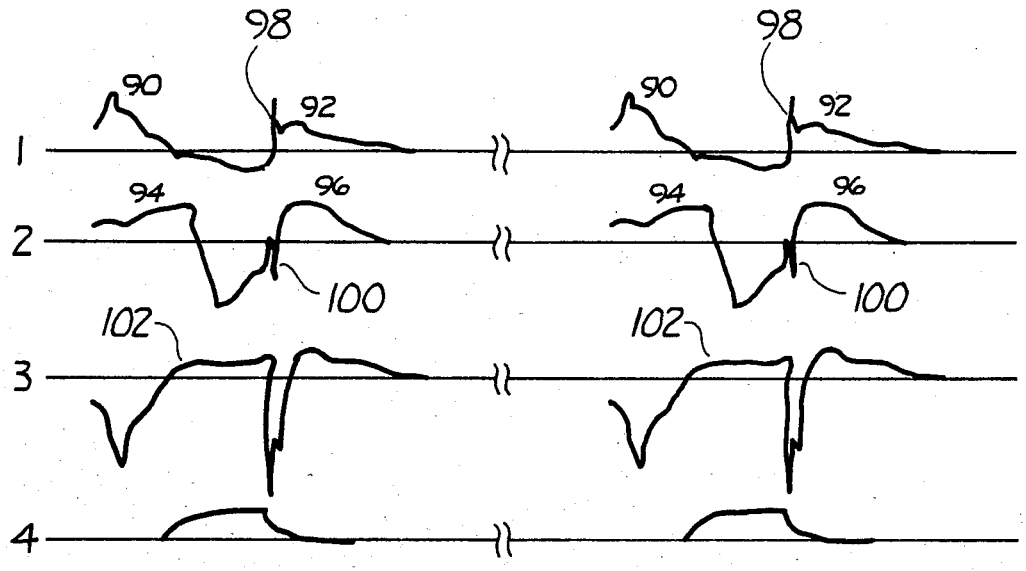
FIG. 5 illustrates various waveforms generated by the system during nominal engine speeds.

With reference to the accompanying drawings and in particular FIG. 1, there is illustrated a magneto 10 comprising a stator 12 and a rotor 14 such relationship is shown schematically. As is known in the art, the stator 12 is mounted apart from the rotor which may be formed or positioned on the engine flywheel 13 or similar rotating engine component. The stator 12 comprises an E-type pickup comprising a core 15 including a crossbar 17 supporting three spaced poles 18, 20 and 22 of width, w and depth, $\alpha$ formed by a plurality of laminations secured together by known means. Each pole terminates at an arcuately shaped end face 24, 26, 28, respectively. The curve of the arcuate end faces 24–28 conforms to the radial path of the rotor 14. The end faces 24–28 are position apart from the rotor 14 by an air gap 30. In the preferred embodiment of the invention the spacing between the pole pieces 18, 20, 22 is asymmetrical, however, this is not believed to be a requirement thereof. More particularly, when viewed in relationship to the direction of rotation of the rotor 14 a first pole pair comprising poles such as 18 and 20 defining a smaller or narrow spacing 32 is encountered first. The poles 20 and 22 respectively define a larger spacing 34. In the preferred embodiment of the invention the width, w, of each pole 18–22 is approximately equal. In addition the narrow pole spacing 32 is approximately equal to the pole width. The wider pole spacing 34, between poles 20 and 22, is approximately twice the narrow spacing 32. In the preferred embodiment of the invention the pole width is approximately 0.3 inches (7.62 mm) and depth is approximately 0.5 inches (12.7 mm).

The center pole 20 carries a plurality of windings or coils. There is situated apart from the end face 26 a first, larger turn, charge winding or coil 40. Such winding 40 terminates at wires 43 and 45. Positioned on the pole 20 closer to the end face 26 is a second smaller turn, trigger coil or winding 42. Such windings 40 and 42 are wound about the pole 20 such that voltages of opposite polarities are induced therein. The trigger winding 42 terminates at a wires 47 and 49. Wire 47 is connected in common to the conductor or wire 44 of coil 40. It should be appreciated that the wires 43, 45, 47 and 49 are diagramatically illustrated. The reverse polarity of the windings 40 and 42 are shown by the conventional "dot" notation in the circuit diagram of FIG. 6. For convenience and ease of manufacture and assembly, the windings 40 and 42 are wound about a plastic bobbin 44 which is received about the pole 20 and during manufacture secured in place by a potting compound or the like.

Positioned within the larger spacing 34 between poles 20 and 22 is a suppression winding or coil generally designated as 46. This suppression coil 46 as shown in FIG. 2 comprises an iron core inductance comprising a plastic bobbin 48 which includes a substantially oblong center 52 into which an iron core 50 is received and about which the suppression winding 46 is wound. The length of the iron core 50 is approximately equal to the depth of the pole pieces as illustrated in FIG. 2. The bobbin 48 is oriented such that its major axis is parallel to the depth of pole 20 and is positioned near the second or trigger coil 42 as more particularly illustrated in FIG. 2.

The system 10 further includes a housing generally shown as 60 which supports the E-shaped stator 12 and its associated circuitry 200 in a compact unit as illustrated in FIGS. 3 and 4. The housing 60 includes a plurality of end portions 62 and 64 which support first and second ignition coils 66 and 68 respectively remote from the stator 12. The circuitry 200, shown in phantom lines is also supported within the housing 60. The invention is intended for use with multiple cylinder engines where simultaneous provision for ignition pulses to more than one cylinder is effective to cause combustion therein. The number of coils used is a matter of choice as is the incorporation of a distributor. Each of the ignition coils 66 and 68 may be wound about a suitable carrier, bobbin or core (not shown) and includes a primary (210, 212) and a secondary winding (224, 226) shown in FIG. 6. The connection of the windings of the ignition coils to the circuit 200 of the present invention is more particularly illustrated in FIG. 6. The grounded ends of the primary and secondary coils are connected to a ground strap 70 which is secured to the engine frame. Each of the ignition coils 66, 68 respectively includes a suitable core provided with a socket 72 for receiving an end of a spark plug wire (not shown). A connector 74 is located within each socket 72 and is connected to one end of its corresponding secondary coil for connection to the spark plug wire.

The housing 60 further includes a central projecting portion 76 defining a rectangular bracket 78 which supports the inner surfaces of the poles 18, 22 of the stator 12 and through which is received pole 20, bobbins 44, 48 and the associated coils 40, 42, 46. The housing 60 is secured to the engine by suitable means such that the pole ends 24–28 are positioned apart from the rotor 14.

Reference is again made to FIG. 1 which further illustrates the rotor 14 which is moved by the engine in synchronism with the combustion process. The rotor 14 as previously mentioned may be attached to the engine flywheel 13 which is movable with the engine crank shaft. The rotor comprises a permanent magnetic device generally illustrated as 80 which generates a varying magnetic flux field in the stator 14. As illustrated in FIG. 1, the permanent magnet device 80 comprises a rectangular magnet 82 separating two pole pieces 84 and 86. The pole pieces 84 and 86 terminate in arcuately shaped end faces 88 and 90. The outward ends 92, 94 of the end faces 84 and 86 are notched to concentrate the magnetic flux therethrough. In the preferred embodiment of the invention the magnet is fabricated of ceramic or rare earth materials. The length across the end faces is slightly greater than the width of the poles 18–22. As an example, the lengths of the end faces may be approximately 0.35 inches (8.8 mm) and the spacing across the magnet 82 approximately 0.5 inches (12.7 mm). The magnet 82 may be poled such that its north pole is oppositely positioned relative to its south pole as viewed along the direction of rotation of the rotor 14. In addition, in the illustrated embodiment of the invention the permanent magnet device 80 is constructed such that the north pole of magnet 82 first interacts with the stator 12 as the rotor 14 is rotated in the direction shown by the solid arrow 89.

Figure 7:
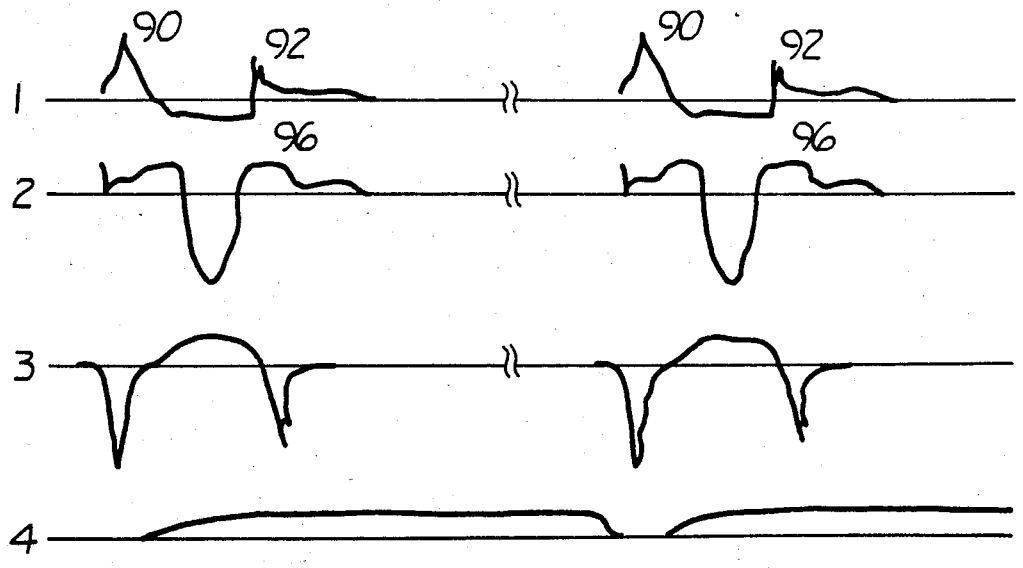
FIG. 7 illustrates the time histories of various waveforms generated by the system at speeds greater than those illustrated in FIG. 5.

Reference is now made to FIG. 5. The waveforms illustrated on FIG. 5 represent various voltages typically generated by the system during nominal speed operation. The waveforms illustrated on lines 1 and 2 represent the voltages induced by the permanent magnet device 80 in the trigger winding 42 and the suppression winding 46, respectively. The waveform shown on line 3 of FIG. 5 illustrates the induced voltage in the charge winding 40 which differs in magnitude from the voltage generated by coil 42 because of the number of turns and, which because of the reverse polarity of the coils 40 and 42, is the inverted counter-part of the wave induced in the trigger winding 42. The waveform shown on line 4 represents the charge on a charge capacitor 216 which is discussed in greater detail below. The waveforms of FIG. 5 and also of FIG. 7 are not drawn to scale. Typically, the maximum output voltage generated by the trigger coil 42 and the suppression coil 46 are approximately ten and six volts, respectively. The output of the charge coil 40 and charge on the charge capacitor 218 are approximately 200–300 volts.

The characteristic signature of the waveforms generated by the respective coils as the permanent magnetic device 80 passes the stator 12 comprises two positive peaks or trigger pulses generally separated by a portion of opposite polarity. The trigger pulses from coil 42 designated as 90, 92 and are shown on FIG. 5, line 1. The trigger pulses from coil 46 are generally designated as 94 and 96 and are shown on FIG. 5, line 2. As would be expected because of the physical displacement of the third coil or suppression winding 46 from the second coil or trigger winding 42 the first and second positive trigger pulses 90, 92 of waveform of lines 1 occur prior in time relative to the respective trigger pulses 94, 96 of the waveform on line 2. As will be seen from the discussion below, because of the novel features of the magneto 10 of the present invention the occurrence of the second trigger pulse 96 from the suppression coil 46 will not always lag behind the second trigger pulse 92 of the trigger coil 42. The transient spikes generally designated as 98 and 100 in the waveforms illustrate noise induced into the windings by the firing of the spark plugs. The waveforms described above will repeat each time the rotor 14 passes the stator 12 as shown.

Figure 6:
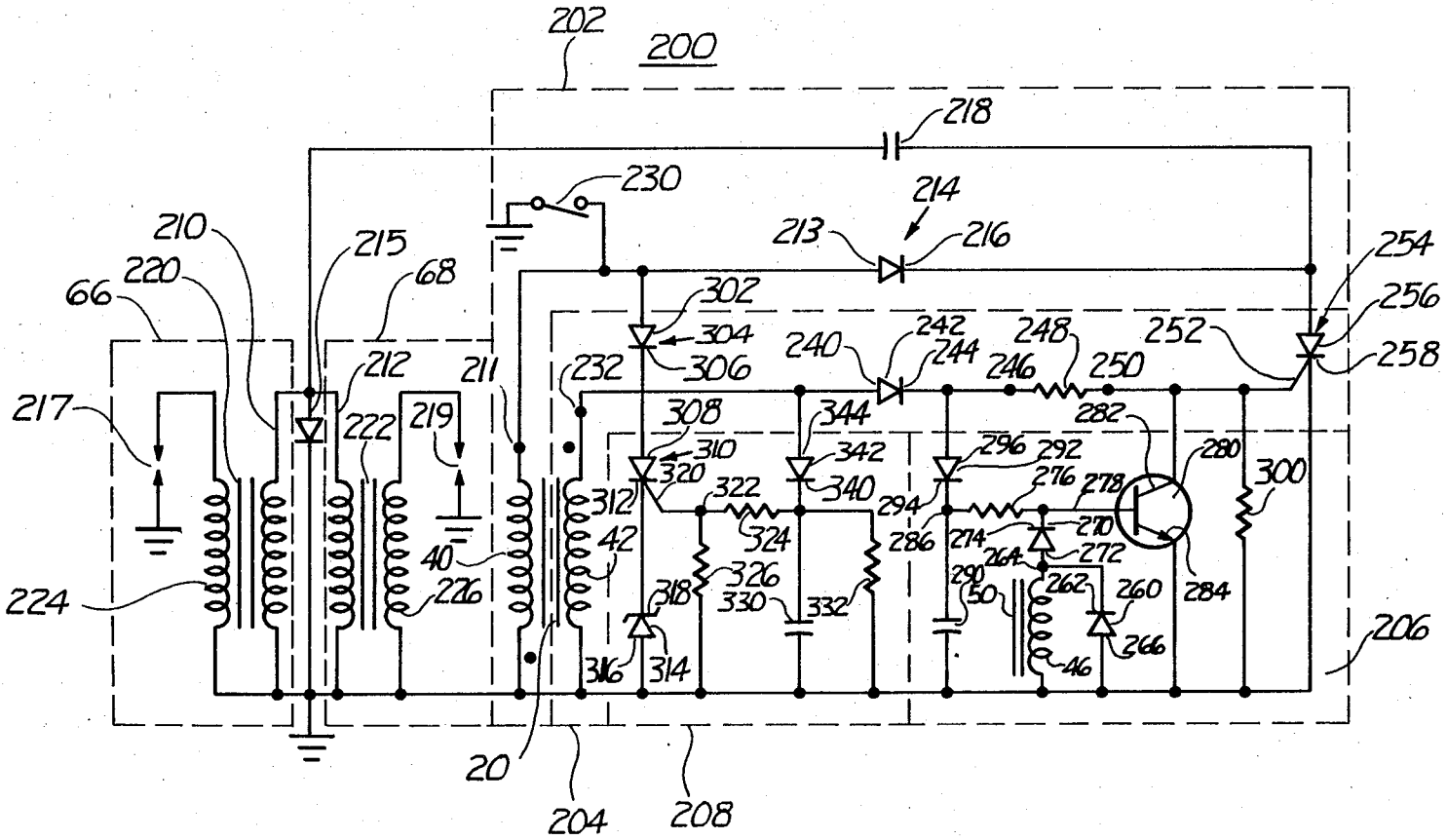
FIG. 6 illustrates the control circuitry utilized by the present invention.

Reference is now made to FIG. 6 which illustrates the control circuit 200 which is used in conjunction with the magneto 10 of the present invention. As previously mentioned, the present invention permits the performing of various engine related functions such as: advance and retard spark timing in conjunction with the ability to charge and discharge a charge capacitor to provide the necessary spark for the spark plugs of the engine, engine speed limiting and reverse engine rotation protection.

The circuitry responsible for accomplishing the above functions is generally shown by the dotted lines of FIG. 6. More specifically, numeral 202 illustrates those circuit components utilized for charging capacitor 218 while numeral 204 shows those components utilized to discharge the capacitor. Numeral 206 identifies those circuit components which accomplish the advance and retard timing functions while numeral 208 identifies those components which perform the speed limiting function. It should be recognized by those skilled in the art that in order to accomplish the various functions of the present invention in an efficient manner some of the components are utilized to accomplish more than one function. As an example, the function of reverse engine protection is accomplished by the timing circuitry 206.

The charging portion 202 of the circuit 200 comprises the first or charge coil, 40 wound about the center pole 20, having its non-grounded terminal 211 connected to the anode 213 of a diode 214. The cathode 216 of the diode 214 is connected to a charge capacitor generally designated 218. The capacitor is connected to the ignition coils 66, 68. More specifically, the capacitor 218 is connected to the primary windings 210, 212 of the respective ignition coils 66, 68 and to the anode of a diode 215. The diode 215 is connected in parallel with the primary coils 210, 212 to ground and aids in the rapid collapse of the magnetic field to produce the spark at the spark plugs 217, 219. Each of ignition coils 66, 68 comprise a ferromagnetic core 220, 222 respectively about which the primary coils 210, 212 and their corresponding secondary coils 224, 226 are wound. One end of each of the secondary coils 224, 226 is communicated to one of the spark plugs 217, 219, respectively. While the other end of these secondary coils 224, 226 is connected in common to ground with the other ends of the coils 40, 42, 46, 210, and 212. A switch generally designated as 230 is connected to the terminal 211 of the first or charge coil 40 which when closed by the operator of the engine short circuits the coil 40 to ground thereby turning off the engine.

As can be seen in conjunction with the waveforms of FIG. 5, the capacitor 218 is charged (see line 4) during the positive going portion 102 of the waveform on line 3.

The portion 204 of circuit 200 comprises means for discharging the capacitor 218 to produce the spark and comprises the second or trigger coil 42 which is wound about the center pole 20. It should be noted that the dot notation shown on coils 40 and 42 illustrates the polarity of the voltages induced therein. The non-grounded terminal 232 of the trigger coil 42 is connected to the anode 240 of a diode 242 which has its cathode 244 connected to the first terminal 246 of a resistor 248. The second terminal 250 of the resistor 248 is connected to a semiconductor switch such as to the gate 252 of a silicon controlled rectifier (SCR) generally designated as 254. The anode 256 of the SCR 254 is connected to the cathode 216 of the diode 214 and the cathode 258 of the SCR is connected to ground.

The spark suppression or advance timing circuitry 206 comprises the third or suppression coil 46 which as illustrated wound about its ferromagnetic core 50. A diode 260 is connected in parallel with the coil 46. More specifically, the anode 262 of the diode 260 is connected to the non-grounded terminal 264 of coil 46. The cathode 266 of the diode 260 is connected to ground. The coil terminal 264 is connected to the anode 272 of diode 270 which has its cathode 274 connected to the junction of resistor 276 and another switch such as the base 278 of the n-p-n transistor 280. The collector 282 of the transistor 280 is connected to the second terminal 250 of the resistor 248 while its emitter 284 is connected to ground. The other end 286 of the resistor 276 is connected to ground through the capacitor 290 and to the junction of the diode 240 and resistor 248 through another diode 292. More specifically the cathode 294 of the diode 292 is connected to the terminal 286 of the resistor 276 and its anode 296 is connected to the terminal 246 of the resistor 248. Another resistor 300 is connected between the gate 252 of the SCR 254 to ground.

The speed limiting function 208 is accomplished in concert with the coils 40 and 42. More specifically, the non-grounded terminal 211 of coil 40 is connected to the anode 302 of diode 304 which has its cathode 306 connected to another semiconductor switch such as to the anode 308 of another SCR 310. The cathode 312 of the SCR 310 is connected to ground through a Zener diode 314. The Zener diode is connected such that its anode 316 is grounded and its cathode 318 is connected to the cathode 312 of the SCR 310. The gate 320 of the SCR 310 is connected to the common terminal 322 of resistors 324 and 326. The other terminal of resistor 326 is grounded. The other terminal of resistor 324 is connected to ground through a capicitor 330. An additional resistor 332 is connected in parallel with the capacitor 330. In addition, the other terminal of resistor 324 is connected to the cathode 340 of diode 342 which has its anode 344 connected in common to terminal 232 of coil 42 and to the anode 240 of the diode 242.

The operation of the system 10 is best understood in conjunction with the circuit 200 of FIG. 6 and the waveforms of FIGS. 5 and 7.

As will be recalled from the discussion above, the waveforms illustrated in FIG. 5 illustrate the engine operating at a nominal speed. Characteristic of the waveforms generated by the trigger coil 42 and the suppression coil 46 are the two positive going trigger pulses 90, 92 and 94, 96, respectively. During engine retard timing the second trigger pulse 92 of coil 42 is used to discharge the capacitor 218. However, during engine advance spark timing this second trigger pulse is suppressed and the discharging of capacitor 218 is controlled by the first trigger pulse 90 of a subsequently generated waveform. Further, at or below the nominal engine speed as illustrated in FIG. 5 the second trigger pulse 96 from coil 46 occurs slightly after the second trigger pulse 92 from coil 42.

Returning now to the first trigger pulses 90 and 94 presented on lines 1 and 2 of FIG. 5 and assuming for illustrative purposes that the capacitor 218 is not charged, it can be seen that during the first positive trigger pulse 90 the voltage induced at the non-grounded terminal 232 of coil 42 is positive. The trigger pulses emanating from coil 42 are communicated to capacitor 290 through the diodes 242 and 292, and to the gate 252 of the SCR 254 through the diode 242 and resistor 248. These trigger pulses will tend to charge capacitor 290 which will rapidly discharge through resistor 276 and through transistor 280 and will also cause the SCR 254 to become conductive thereby shorting the capacitor 218 to ground. Because of the delays inherent in communicating the trigger pulse to the base 278 of transistor 280 caused by the diode 290, resistor 276 and the base-emitter junction of the transistor 280 the transistor 280 will become conductive after the trigger pulse 90 has been communicated to the gate 252 of the SCR 254. In addition, during this portion of the cycle the voltage induced at the non-grounded terminal 211 of the charge winding or coil 40 is negative and as such the diode 214 blocks the flow of current to the capacitor 218. Consequently, from the above description it can be seen that during first trigger pulse 90 portion of the cycle the act of making the SCR 254 conductive has no appreciable effect on the operation of the system.

The first trigger 94, shown on line 2 on FIG. 5, generated by the suppression coil 46 will cause the transistor 280 to become conductive thereby shorting the gate 252 of the SCR 254 to ground. Since this first trigger pulse 94 from the suppression coil 46, for engine speeds at or below the nominal speed, occurs after the occurrence of the first trigger pulse 90 from the trigger coil 42, the act of shorting the gate 252 of the SCR 254 to ground similarly has no appreciable effect on the operation of the system during this initial portion of the cycle.

During the time the voltage induced in the coil 46 is positive, the capacitor 290 will charge slightly through resistor 276. This voltage will discharge rapidly through the resistor 276 and transistor 280.

As the rotor 14 continues past the stator 12 the voltage induced in the charge coil 40 goes positive, (see line 3, FIG. 5) as indicated by numeral 102 thereby causing the capacitor 218 to charge as indicated on line 4 of FIG. 5. Thereafter, the second trigger pulse 92 is generated in coil 42 which as described above drives the gate 252 of the SCR 254 positively, which in turn drives the SCR 254 into its conductive state thereby shorting the capacitor 218 to ground. This action causes the energy stored in capacitor 218 to be transferred to the primary coils 210, 212 thereby causing the spark plugs 217, 219 to fire. As previously mentioned, the transient portions of the waveforms of FIG. 5 are the result of spark plug firing. The second trigger pulse 96 from coil 46 again turns transistor 280 conductive, however, since the capacitor 218 has been discharged the turning on of transistor 280 has no marked effect on the circuit operation.

The above description described the operation of the system during the normal, low speed, retard ignition spark timing. The prescribed amount of retard timing is achieved by the physical placement of the rotor 14 and the stator in a known manner such that the rotor passes the stator 12 in correspondence with a predetermined number of degrees of ignition timing retard as measured relative to a position such as the top dead center (TDC) position of the pistons within their respective combustion chambers.

The magneto 10 of the present invention generates a unique walking waveform which has been studied in our laboratory. As previously mentioned, it is characteristic of each of the various coils embedded in the stator 12 to produce a waveform having two trigger pulses. Such relationship having previously been discussed with regard to FIG. 5. From the discussion below it will be seen that the phase relation of the second trigger pulse 96 produced by the suppression coil 46 is variable in time relative to the generation of the second trigger pulse 92 produced by the trigger coil 42. It will be shown that the occurrence of the second trigger pulse 96 generated by the suppression coil 46 advances in time with respect to the second pulse 92 generated by the trigger coil 42 as a function of engine speed. This unique behavior is advantageously used to change ignition timing from spark retard to spark advance timing.

Lines 1 and 2 of FIG. 7 illustrate the advanced movement of the second trigger pulse 96 at an increased engine speed such that this second trigger pulse 96 now occurs relatively simultaneously with or slightly before the second trigger pulse 92 of the trigger coil 46. The engine speed at which the second trigger pulse 96 overtakes the trigger pulse 92 is determined by the spacing between the coils 42 and 46. A greater clockwise positioning or spacing between the coils 42 and 46 causes the second trigger pulse 96 to overtake the trigger pulse 92 at a higher rotational engine speed. Similarly, a more counterclockwise positioning or spacing causes the opposite to occur. As will be seen from the discussion below, at this overtaking speed engine spark timng is automatically switched from retard ignition timing to advance ignition timing. The specific overtaking speed is based upon the performance characteristics of the particular engine used. In addition laboratory experiments have shown that the overtaking speed varies approximately one revolution per minute for each one thousandths of an inch (0.0254 mm) spacing between the coils 42 and 46. As such, once the characteristics of the engine and the speed at which advanced spark timing is to begin are determined the required spacings between the coils 42 and 46 may be established thereby permitting spark advance timing to automatically occur at this predetermined engine speed and higher speeds without further engine or system calibration.

In view of the above, the operation of the system in its advance spark timing mode of operation will be discussed. The waveforms on lines 1, 2, 3 and 4 of FIG. 7 illustrate the output voltages produced by coils 40, 42, 46 and the charge on capacitor 218 at the overtaking speed of operation. As the voltage produced by coil 40, (line 3), increases positively the capacitor 218 will become charged as shown on line 4 of FIG. 7. At a predetermined speed of operation the phase of the second trigger pulse 96 will have advanced relative to the generation of the second trigger pulse 92 generated by the trigger coil 42 such that the transistor 280 is made conductive relatively simultaneously with the generation of trigger pulse 92 thereby shorting the gate 252 of the SCR 254 to ground prior to the generation of trigger pulse 92. Upon the generation of the second trigger pulse 92 such positive going waveform will be ineffective to place the SCR 254 in its conductive state because of the effective ground produced by the conduction of the transistor 280. As such, the second trigger pulse 92 is shunted or suppressed. The effect of suppressing the trigger pulse 92 inhibits the transfer of the energy in the capacitor 218 to the ignition coils 66 and 68 to cause a spark under the operation of the second trigger pulse 92 as was the situation during retard timing. However, during the next revolution of the rotor 14 the first trigger pulse 90 (line 1) produced by the trigger coil 42 is effective to control the conductivity of the SCR 254 thereby causing the energy stored in the capacitor 218 to be transferred to the ignition coils 66 and 68 producing a spark in advance of the corresponding engine position when using the second trigger pulse 92.

The suppression of the second trigger pulse 92 generated by the trigger coil 42 is accomplished in a slightly different manner at speeds which are significantly above the overtaking speed. Such suppression does not use the output of the suppression coil to suppress the second trigger pulse 92. As the speed of the engine increases, the second trigger pulse 96 generated by the suppression coil 46 will advance in time so that it is completed before the generation of second trigger pulse 92. As can be appreciated since the second trigger pulse 96 has terminated prior to the initiation of the second trigger pulse 92, the second trigger pulse 96 is ineffective to suppress the later recurring trigger pulse 92. Further, it should be appreciated that at this significantly increased engine speed the trigger pulse (90 and 92) generated by the trigger coil occur relatively close in time. As will be recalled from the discussion above, the trigger pulses 90 and 92 from the trigger coil are effective to charge the capacitor 290. At these increased engine speeds, the second trigger pulse 92 will occur prior to the time that the voltage on the capacitor 290 (generated by the first trigger pulse 90) has dissipated. This voltage is effective to place the transistor 280 in a conductive state and consequently transistor 280 provides an effective short circuit to suppress the second trigger pulse 92 thereby preventing discharge of the capacitor 216 under control of this second trigger pulse 92. The discharging of the capacitor 218 at these increased engine speeds will occur under the control of the next subsequent first trigger pulse 90 in a manner as discussed above.

The circuit 200 further provides means for preventing the reverse rotation of the engine. During such reverse rotation of the engine the rotor 14 passes the stator 12 in a direction opposite to the normal or correct direction of rotation. Since the rotor 14 will pass the winding 46 prior to passing the winding 42 the phase of the trigger pulses generated by coils 46 and 42 are reversed relative to those shown in FIGS. 5 and 7, that is, the trigger pulses produced by winding 46 will first turn the transistor 280 on which suppresses any subsequent pulses generated by winding 42 thereby preventing the triggering of the SCR 254. Since the capacitor 218 cannot be discharged the engine is prevented from running in the incorrect direction.

The following discussion is directed to the operation of the speed limiting portion 208 of the circuit 200. During the first trigger pulse 90 generated by coil 42 the capacitor 330 will be charged. The voltage on capacitor 330 is communicated to the gate 320 of another semiconductor switch such as the SCR 310 through the resistor network comprising resistors 324 and 326 thereby turning SCR 310 conductive. The SCR 310 will remain conductive as long as the voltage communicated thereto is above the threshold value of the SCR 310. The discharging of capacitor 330 is governed primarily by the parallel resistor 332. As previously mentioned during the positive going portion 102 of the voltage waveform generated by the charge coil 40 the capacitor 218 will be charged. In addition, such positive voltage is communicated to the anode 308 of the SCR 310. At low engine speeds the voltage on the capacitor 330 will have discharged prior to the time that a positive going voltage 102 is generated by the charge coil 40. Consequently, at low engine speeds the SCR 310 will remain non-conductive during the generation of the positive voltage portion generated by the coil 40. However, at higher engine speeds the capacitor 330 will not have discharged and consequently the SCR 310 will remain in its conductive state such that upon the generation of the positive voltage signal 102 by coil 40 such voltage signal will be shunted away from capacitor 218 such that capacitor 218 will not be charged and no ignition spark can occur until the engine slows down.

Many changes and modifications in the above described embodiment of the invention can of course be carried out without departing from the scope thereof. Accordingly that scope is intended to be limited only by the scope of the appended claims.

What is claimed is:

1. A magneto comprising:

means for generating a first induced voltage; and means for generating a second induced voltage having a phase which varies relative to said first induced voltage in proportion to the speed of the engine, wherein below a predetermined engine speed said second induced voltage occurs after said first induced voltage, and wherein at or above said predetermined engine speed said second induced voltage occurs simultaneously with or before said first induced voltage.

2. A magneto for an engine ignition system comprising:

means for generating first induced voltage characterized by a first trigger pulse of a first polarity, and a second trigger pulse of said first polarity; and means for generating a second induced voltage characterized by a first trigger pulse of said first polarity followed, and a second trigger pulse having a phase which varies relative to said second trigger pulse of said first induced voltage in proportion to the speed of the engine, wherein below a predetermined engine speed said second trigger pulse of said second induced voltage occurs after said second trigger pulse of said first induced voltage, and wherein at or above said predetermined engine speed said second trigger pulse of said second induced voltage occurs simultaneously with or before said second trigger pulse of said first induced voltage.

3. The magneto as defined in claim 2 further including means for generating a third induced voltage of polarity opposite to the polarity of said first induced voltage.

4. A magneto for an engine ignition system comprising:

an E-type pickup or stator comprising a core including three parallel extending poles terminating at ends;

a rotor comprising permanent magnet means for producing a varying flux field in said stator, said poles defining a first spacing between a second or center pole and a first pole and a second spacing between said center pole and a third pole, said stator positioned relative to said rotor such that said rotor moves across said stator from said first pole toward said third pole;

a first or charge coil wound about said center pole;

a second or trigger coil wound about said center pole;

a third or suppression coil wound about a ferromagnetic core positioned in said second spacing remote from said core proximate said end face of said center pole and electrically isolated, from said trigger coil.

5. The magneto as defined in claim 4 wherein the width of each of said poles, measured in the direction of movement of said rotor is approximately equal to said first spacing.

6. The magneto as defined in claim 5 wherein said poles are asymmetrically spaced and wherein said first spacing is smaller than said second spacing.

7. The magneto as defined in claim 6 wherein said second spacing is approximately twice as large as said first spacing.

8. The magneto as defined in claim 7 wherein said trigger coil is positioned on said center pole proximate its end face.

9. The magneto as defined in claim 7 wherein said suppression coil is wound about an axis that is parallel to said center pole.

10. The magneto as defined in claim 9 wherein the length of said ferromagnetic core is substantially equal to the depth of said center pole.

11. The magneto as defined in claim 10 wherein said permanent magnet means comprises a substantially rectangular permanent magnet, including end faces of opposite polarity facing said end faces of said poles.

12. The magneto as defined in claim 11 wherein said permanent magnet means includes a plurality of pole pieces positioned adjacent said magnet defining said end faces.

13. The magneto as defined in claim 12 wherein said permanent magnet means comprises means for concentrating the magnetic flux density.

14. The magneto as defined in claim 13 wherein said concentrating means comprises pole pieces having a tapered cross-sectional area.

15. The magneto as defined in claim 14 wherein the end faces of said poles and the end faces of said pole pieces are arcuately shaped.

* * * * *